US006060840A

United States Patent [19]

Foo et al.

[11] Patent Number: 6,060,840

[45] Date of Patent: May 9, 2000

[54] METHOD AND CONTROL CIRCUIT FOR CONTROLLING AN EMISSION CURRENT IN A FIELD EMISSION DISPLAY

[75] Inventors: Ken Kok Foo, Chandler; Robert C. Rumbaugh, Scottsdale, both of Ariz.

[73] Assignee: Motorola, Inc., Schaumburg, Ill.

[21] Appl. No.: 09/253,100

[22] Filed: Feb. 19, 1999

[51] Int. Cl.[7] ..... G09G 3/10

[52] U.S. Cl. ..... 315/169.1; 315/291; 315/307; 345/74

[58] Field of Search ..... 315/169.1, 291, 315/297, 307, 169.3, 169.2, 169.4, 167, 349; 345/74

[56] References Cited

U.S. PATENT DOCUMENTS

| | | | |
|---|---|---|---|
| 5,157,309 | 10/1992 | Parker et al. | 315/169.1 |
| 5,262,698 | 11/1993 | Dunham | 315/169.1 |
| 5,313,140 | 5/1994 | Smith et al. | 315/169.1 |
| 5,404,081 | 4/1995 | Kane et al. | 315/169.1 |
| 5,514,937 | 5/1996 | Kane et al. | 315/169.1 |
| 5,721,560 | 2/1998 | Cathey, Jr. et al. | 345/74 |
| 5,808,425 | 9/1998 | Harle | 315/381 |
| 5,847,515 | 12/1998 | Lee et al. | 315/169.1 |
| 5,910,792 | 6/1999 | Hansen et al. | 345/74 |
| 5,936,354 | 8/1999 | Smith et al. | 315/169.1 |
| 5,940,052 | 8/1999 | Xia et al. | 345/74 |
| 5,961,362 | 10/1999 | Chalamala et al. | 445/59 |

*Primary Examiner*—Don Wong
*Assistant Examiner*—Tuyet T. Vo
*Attorney, Agent, or Firm*—S. Kevin Pickens

[57] ABSTRACT

A method for controlling an emission current (134) in a field emission display (100) includes performing at start-up the steps of providing at an anode (138) a voltage less than an operating anode voltage, receiving emission current (134) at anode (138), concurrently measuring a power output of a power supply (146) connected to anode (138), and using the measured power output to adjust an offset voltage applied to a gate extraction electrode (126). A field emission display (100) includes a control circuit (111), which has a sensor (150), a current controller (154), and a gate voltage source (158). Sensor (150) is designed to be connected to power supply (146). Gate voltage source (158) is connected to gate extraction electrode (126) and applies thereto the offset voltage, which is manipulated by current controller (154) in response to an output signal (152) of sensor (150).

17 Claims, 9 Drawing Sheets

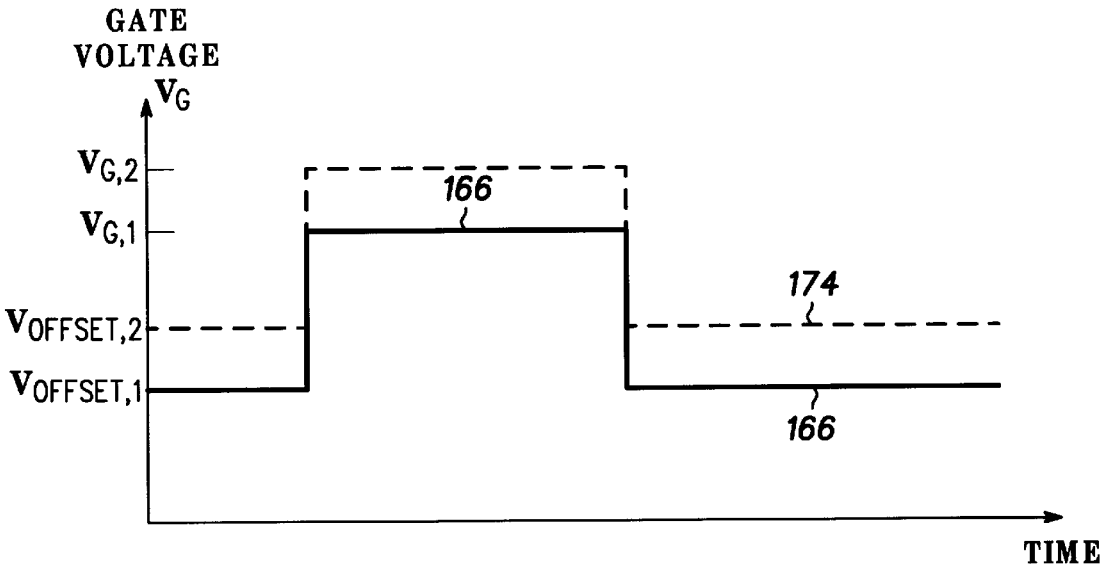
FIG. 5
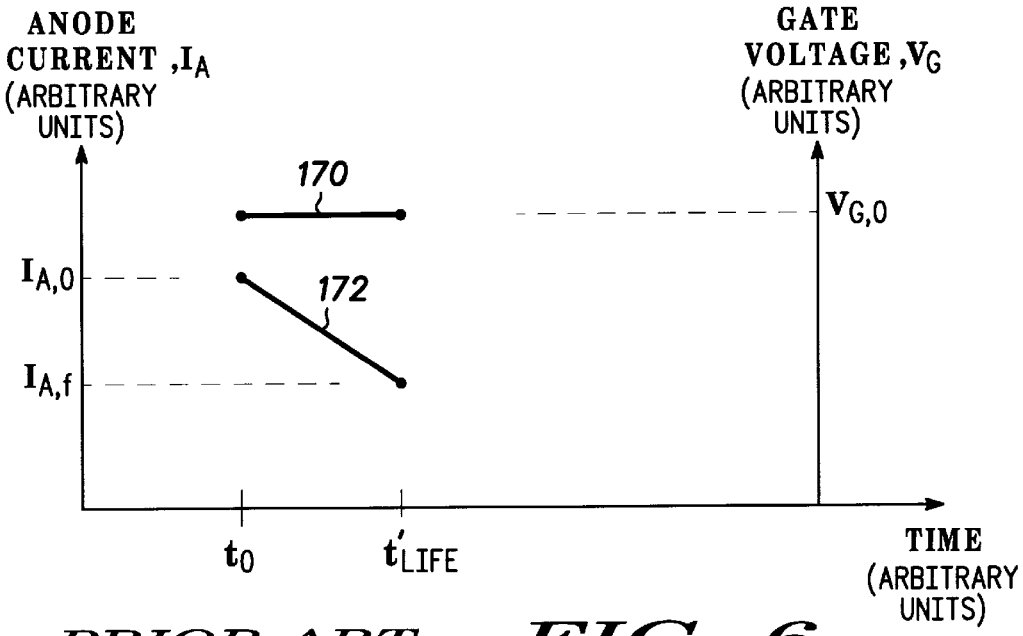
- PRIOR ART - FIG. 6

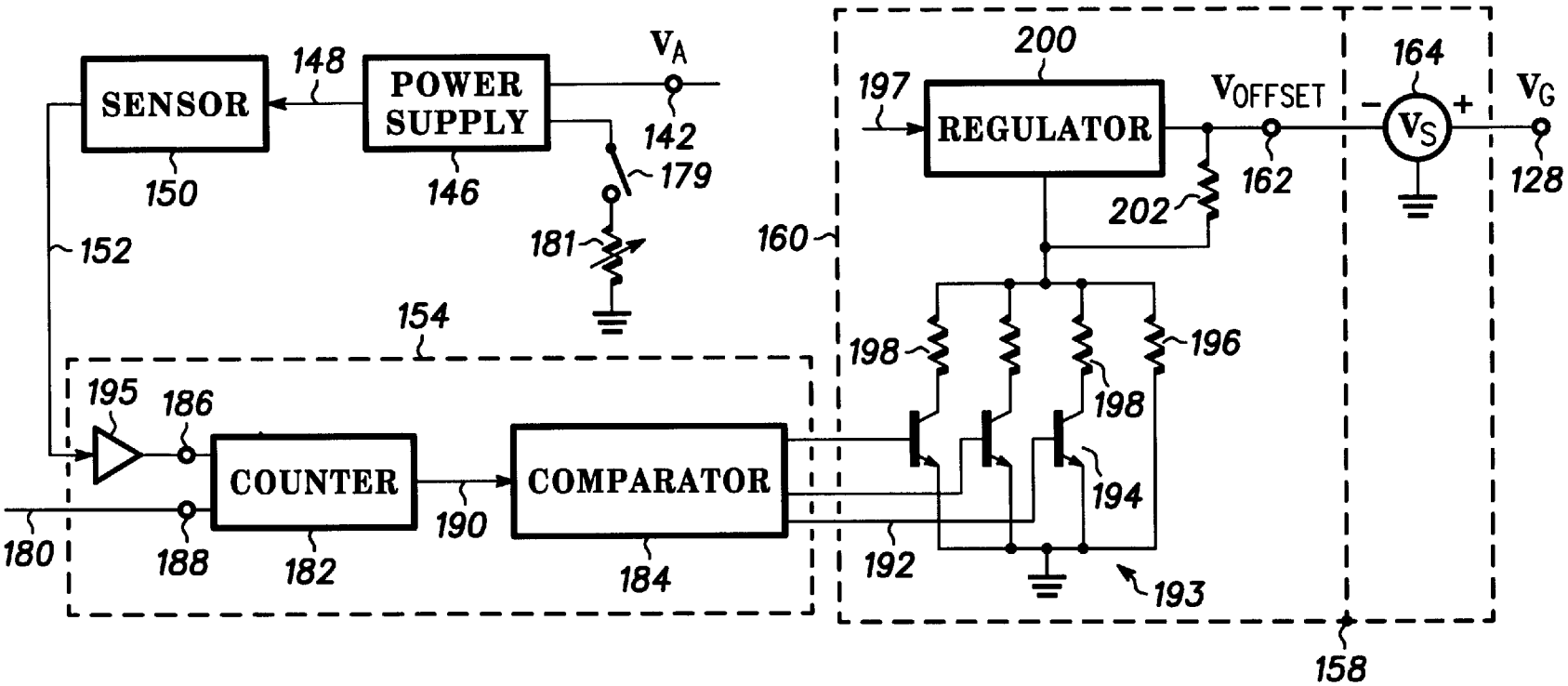
111 FIG. 8

METHOD AND CONTROL CIRCUIT FOR CONTROLLING AN EMISSION CURRENT IN A FIELD EMISSION DISPLAY

FIELD OF THE INVENTION

The present invention relates, in general, to methods for controlling field emission displays, and, more particularly, to methods and circuits for maintaining constant emission current in field emission displays.

BACKGROUND OF THE INVENTION

Field emission displays are well known in the art. A field emission display includes an anode plate and a cathode plate that define a thin envelope. The cathode plate includes column electrodes and gate extraction electrodes, which are used to cause electron emission from electron emitter structures, such as Spindt tips.

During the operating life of a field emission display, the emissive surfaces of the electron emitter structures can be altered, such as by chemically reacting with contaminants that are evolved from surfaces within the display envelope. The contaminated emissive surfaces typically have electron emission properties that are inferior to those of the initial, uncontaminated emissive surfaces. In particular, contamination causes the electron emission current to decrease for a given set of operating parameters.

It is known in the art to provide a uniform and constant electron emission current by coupling a current source to each of the electron emitter structures. The current source is controlled to provide the desired emission current. However, this scheme can result in a complicated device that is difficult to fabricate and difficult to control.

Accordingly, there exists a need for a method and means for controlling the emission current in a field emission display, which overcome at least some of these shortcomings.

BRIEF DESCRIPTION OF THE DRAWINGS

Referring to the drawings:

FIG. 5 is a graph of gate voltage before and after a step of adjusting a gate voltage to control the emission or anode current, in accordance with the invention;

FIG. 6 illustrates graphs of anode current and gate voltage for a prior art method of operating a field emission display;

FIG. 8 is a circuit diagram of a control circuit for controlling emission current, in accordance with the preferred embodiment of the invention;

Figure 1:
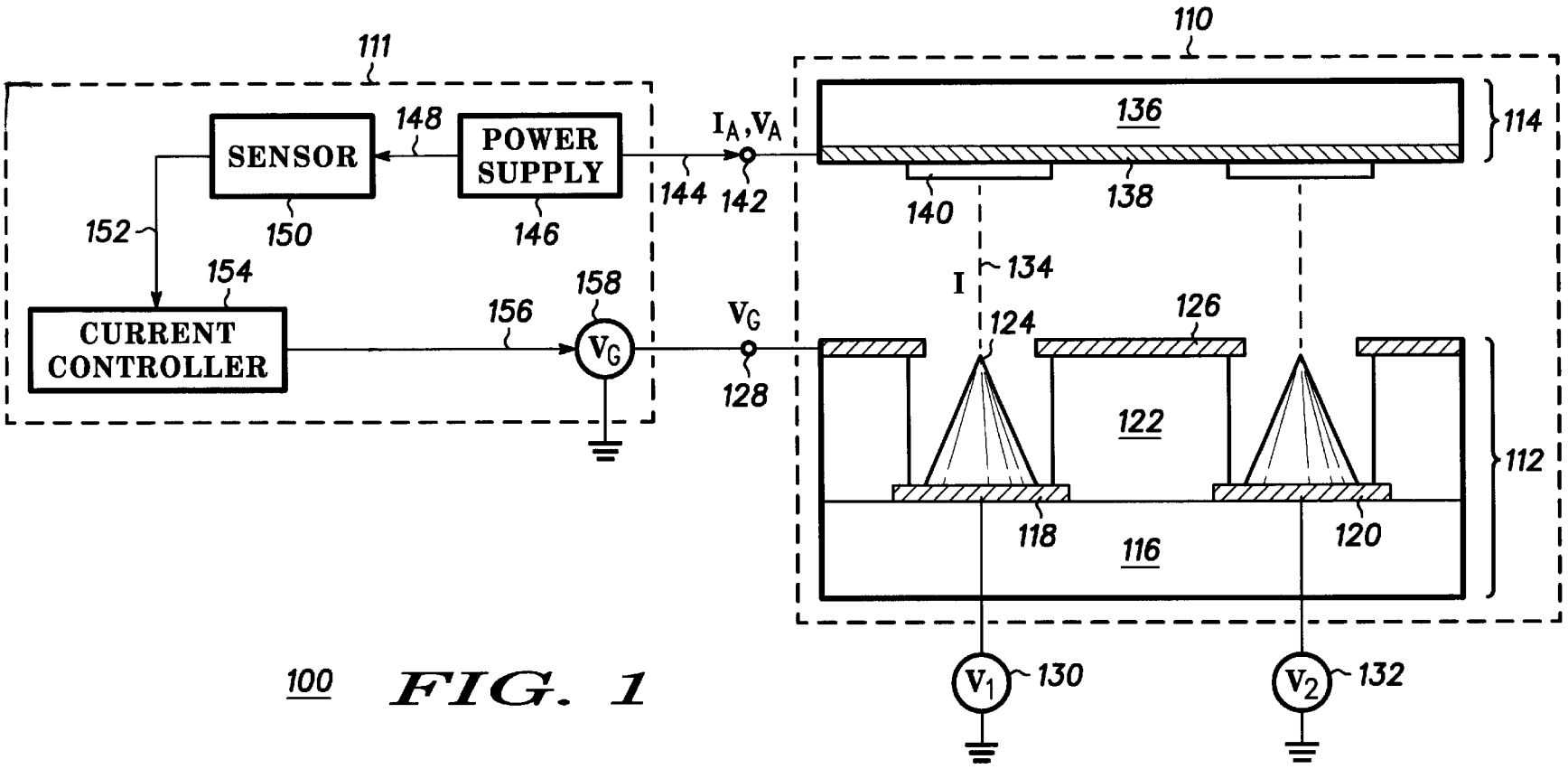
FIG. 1 is a schematic representation of a field emission display, in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a method and a field emission display useful for maintaining a constant emission current over the operating lifetime of the display. The method of the invention includes the steps of measuring an emission current, comparing the measured value to a set point value, and, if the values are not equal, manipulating a gate voltage to cause the emission current to approach the set point value. The method is executed from time to time, such as at each start-up of the display. In this manner, a constant emission current is achieved over the lifetime of the display, resulting in the benefit of constant brightness of the display image. Furthermore, the method and display of the invention provide an improved operating lifetime, which is greater than the lifetime of an equivalent display operated at a constant gate voltage.

FIG. 1 is a schematic representation of a field emission display (FED) 100 in accordance with a preferred embodiment of the invention. FED 100 includes an FED device 110 and a control circuit 111 for controlling emission current.

FED device 110 includes a cathode plate 112 and an anode plate 114. Cathode plate 112 includes a substrate 116, which can be made from glass, silicon, and the like. A first column electrode 118 and a second column electrode 120 are disposed upon substrate 116. First column electrode 118 is connected to a first voltage source 130, $V_1$, and second column electrode 120 is connected to a second voltage source 132, $V_2$. A dielectric layer 122 is disposed upon column electrodes 118, 120, and further defines a plurality of wells.

An electron emitter structure 124, such as a Spindt tip, is disposed in each of the wells. Anode plate 114 is disposed to receive an emission current 134, which is defined by the electrons emitted by electron emitter structures 124. A gate extraction electrode 126 is formed on dielectric layer 122 and is spaced apart from and is proximate to electron emitter structures 124. Column electrodes 118, 120 and gate extraction electrode 126 are used to selectively address electron emitter structures 124.

To facilitate understanding, FIG. 1 depicts only a couple of column electrodes and one gate extraction electrode. However, it is desired to be understood that any number of column and gate extraction electrodes can be employed. An exemplary number of gate extraction electrodes for an FED device is 240, and an exemplary number of column electrodes is 960. Methods for fabricating cathode plates for matrix-addressable field emission displays are known to one of ordinary skill in the art.

Anode plate 114 includes a transparent substrate 136 made from, for example, glass. An anode 138 is disposed on transparent substrate 136. Anode 138 is preferably made from a transparent conductive material, such as indium tin oxide. In the preferred embodiment, anode 138 is a continuous layer that opposes the entire emissive area of cathode plate 112. That is, anode 138 preferably opposes the entirety of electron emitter structures 124.

An input 142 of anode 138 is designed to be connected to an output of a power supply 146. Power supply 146 includes one of several types of power supplies, such as a stepping-up transformer, a piezo electric power supply, and the like. In the preferred embodiment, power supply 146 is a variable, high-voltage power supply, which can provide an anode voltage, $V_A$, on the order of 5000 volts. An anode current 144, $I_A$, flows from power supply 146 to anode 138. For the values of the anode voltage described herein, a useful assumption is that the magnitude of anode current 144 is equal to the magnitude of emission current 134.

A plurality of phosphors 140 is disposed upon anode 138. Phosphors 140 are cathodoluminescent. Thus, phosphors 140 emit light upon activation by emission current 134. Methods for fabricating anode plates for matrix-addressable field emission displays are also known to one of ordinary skill in the art.

In accordance with the invention, control circuit 111 includes a sensor 150. An input of sensor 150 is connected to power supply 146. An output signal 148 flows from power supply 146 to sensor 150. Output signal 148 contains information corresponding to the operating parameters of power supply 146. For example, output signal 148 can contain information about the electrical current, power output, or duty cycle of power supply 146.

In accordance with the method of the invention, emission current 134 or anode current 144 is measured directly, as by making a current measurement, or indirectly. Indirect detection entails extraction of information about emission current 134 from the measured operating parameter of power supply 146. For example, the power output of power supply 146, to a useful approximation, is proportional to anode current 144 and, correspondingly, emission current 134.

Sensor 150 is responsive to output signal 148 and generates an output signal 152, which is useful for activating a current controller 154. Output signal 152 also contains information corresponding to an operating parameter of power supply 146.

Current controller 154 has an output connected to an input of a gate voltage source 158. An output of gate voltage source 158 is connected to an input 128 of gate extraction electrode 126. In response to output signal 152 of sensor 150, current controller 154 generates an output signal 156. Output signal 156 manipulates gate voltage source 158 to adjust a gate voltage, $V_G$, at gate extraction electrode 126. The gate voltage is adjusted by an amount sufficient to cause emission current 134 and, correspondingly, anode current 144 to reach a set point, desired value.

Figure 2:
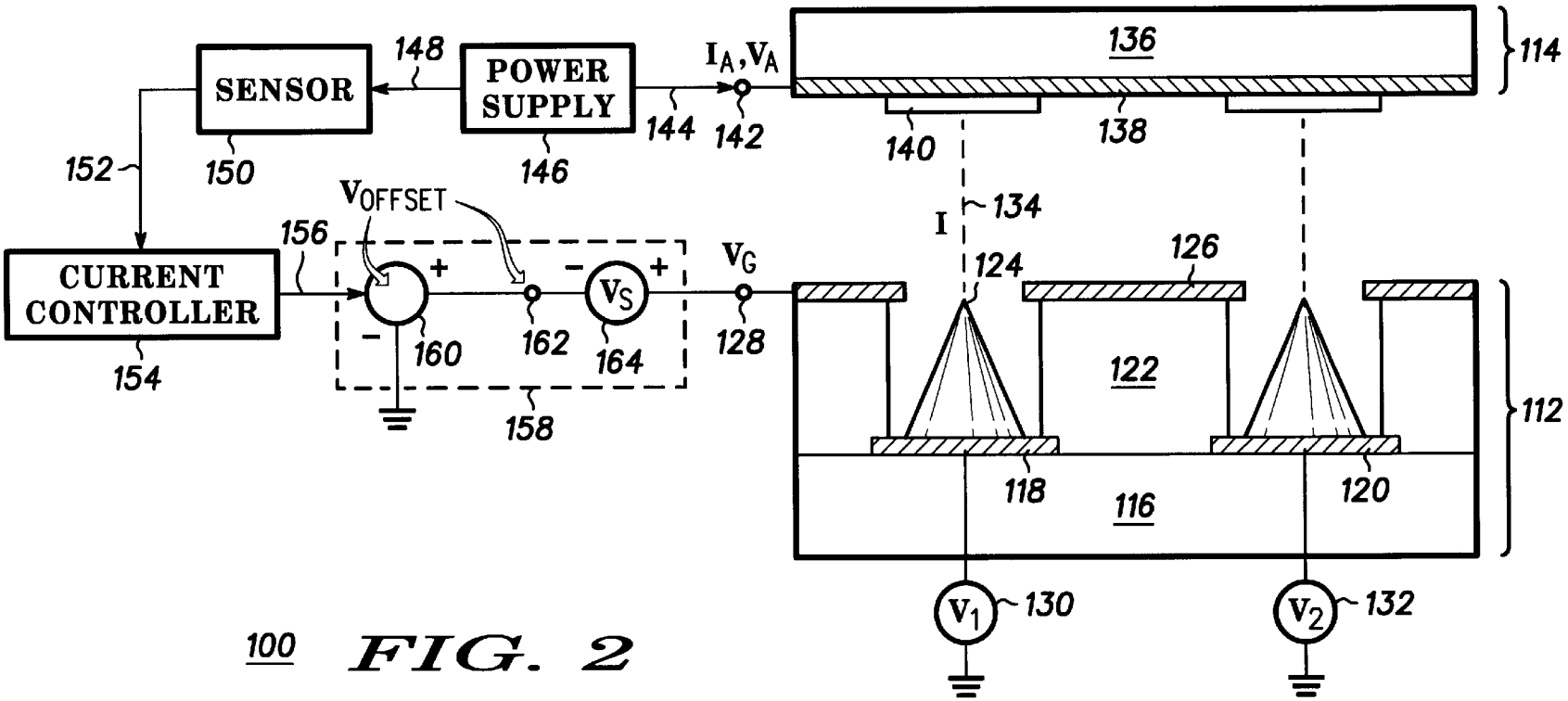
FIG. 2 is a schematic representation of a field emission display having a current controller that manipulates an offset voltage source, in accordance with the preferred embodiment of the invention.

FIG. 2 is a schematic representation of FED 100 having current controller 154 that manipulates an offset voltage source 160, in accordance with the preferred embodiment of the invention. In the embodiment of FIG. 2, gate voltage source 158 includes offset voltage source 160 and a scanning voltage source 164. Offset voltage source 160 has an input for receiving output signal 156 of current controller 154. To adjust the gate voltage in accordance with the invention, output signal 156 manipulates offset voltage source 160.

Offset voltage source 160 provides an offset voltage, $V_{OFFSET}$, at an output 162. Scanning voltage source 164 is useful for adding a scanning voltage, $V_S$, to the offset voltage. Offset voltage source 160 and scanning voltage source 164 are operably connected to achieve the addition of the offset and scanning voltages. In the embodiment of FIG. 2, offset voltage source 160 is connected in series with scanning voltage source 164, such that output 162 of offset voltage source 160 is connected to a negative input of scanning voltage source 164. Scanning voltage source 164 is activated to provide the scanning voltage by control circuitry (not shown).

Figure 3:
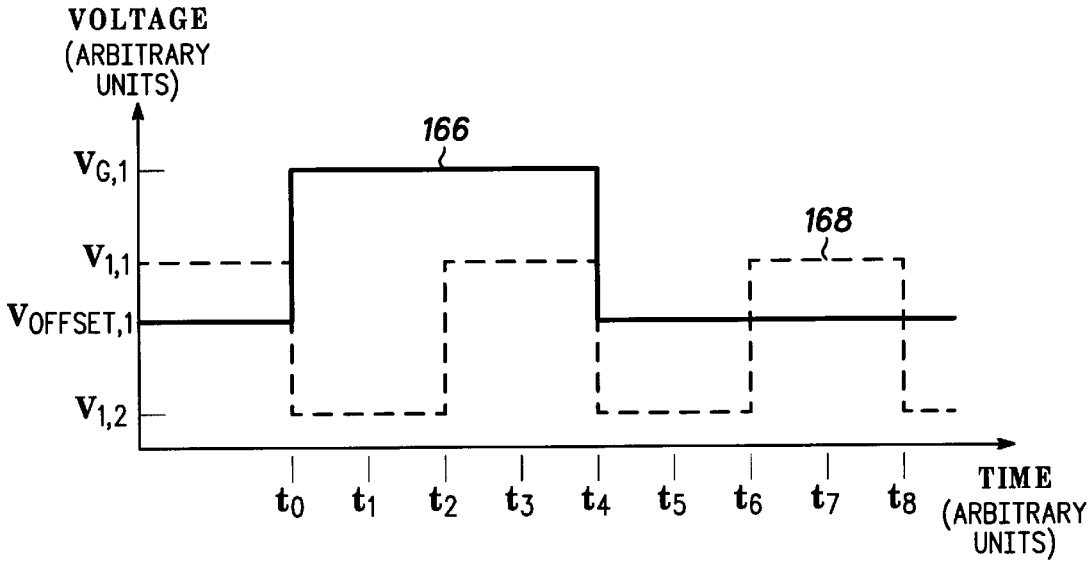
FIG. 3 is a timing diagram illustrating a method for operating a field emission display, in accordance with the invention.

FIG. 3 is a timing diagram illustrating a method for operating FED 100 during the display mode of operation of FED 100. The display mode of operation is characterized by the creation of a display image at anode plate 114. Represented in FIG. 3 is the selective addressing of electron emitter structure 124 at the intersection of gate extraction electrode 126 and first column electrode 118. FIG. 3 illustrates a graph 166 of gate voltage and a graph 168 of column voltage, $V_1$, at first column electrode 118. Before $t_0$, the column voltage is equal to $V_{1,1}$ and the gate voltage is equal to $V_{OFFSET,1}$. Because the gate voltage is less than the column voltage, no electron emission occurs. At $t_0$, scanning voltage source 164 is activated, such that a scanning voltage is added to $V_{OFFSET,1}$, resulting in a gate voltage of $V_{G,1}$.

Between times t0 and t4, gate extraction electrode 126 is being scanned. That is, electron emitter structures 124 that are located along gate extraction electrode 126 can be caused to emit if an appropriate potential is applied to the corresponding column electrodes. In the example of FIG. 3, electron emitter structure 124 at first column electrode 118 is caused to emit between times $t_0$ and t2 by applying a column voltage of $V_{1,2}$. That is, the potential difference, $\Delta V$, between the column voltage and the gate voltage is sufficiently large to cause electron emission of a desired value.

At time $t_2$, the column voltage is returned to $V_{1,1}$, resulting in a $\Delta V$ that is insufficient to cause emission, and electron emission ceases. At time $t_4$, the scanning of gate extraction electrode 126 is terminated by deactivating scanning voltage source 164, so that the gate voltage returns to the offset value.

Between times $t_4$ and $t_8$, a different gate extraction electrode is scanned. Between times $t_4$ and $t_6$, first column electrode 118 is once again activated to cause emission at the scanned gate extraction electrode. During the display mode of operation, the anode voltage, $V_A$, is selected to provide a desired brightness level for the light output from anode plate 114. For example, an operating anode voltage, $V_{A,OP}$, on the order of thousands of volts can be employed.

Figure 4:
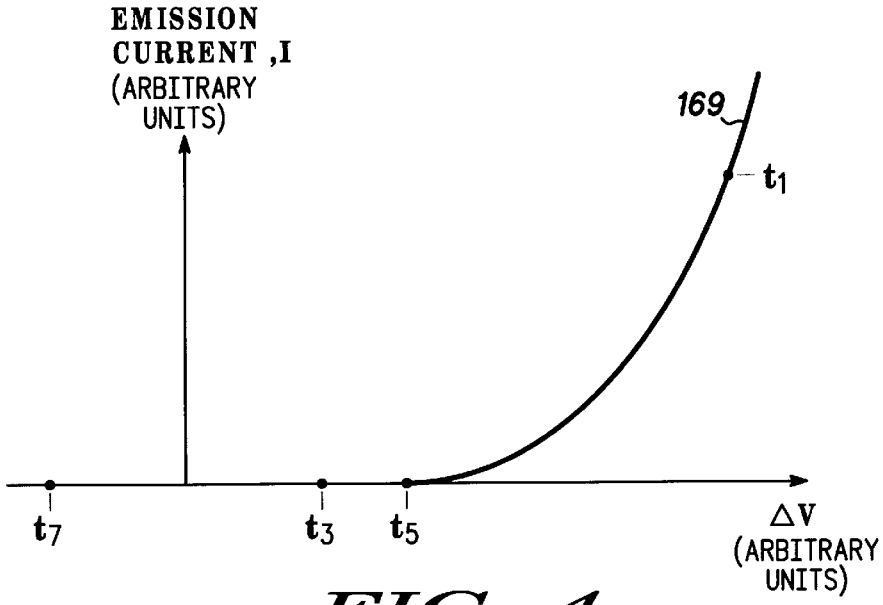
FIG. 4 is a graph of emission current versus potential difference (between column voltage and gate voltage) and further indicates operating points corresponding to various times represented in FIG. 3.

FIG. 4 illustrates a graph 169 of emission current versus potential difference, $\Delta V$, between the column voltage and the gate voltage, and further indicates operating points corresponding to various times represented in FIG. 3. At time $t_1$, emission current 134 is activated, whereas at times $t_3$, $t_5$, and $t_7$, electron emission is negligible.

FIG. 5 illustrates graph 166 of FIG. 3 and a graph 174 of the gate voltage before and after, respectively, a step of adjusting the gate voltage to control the emission or anode current in accordance with the invention. During the operation of FED 100, the offset voltage is initially set at $V_{OFFSET,1}$. When gate extraction electrode 126 is scanned, the scanning voltage is added, resulting in a gate voltage of $V_{G,1}$.

At a subsequent time in the operation of FED 100, the gate voltage is adjusted in accordance with the invention. If emission current 134 has decreased, the adjusted gate voltage, as indicated by graph 174, is greater than the initial gate voltage. During the adjustment, the offset voltage is increased to $V_{OFFSET,\ 2}$. Subsequently, when gate extraction electrode 126 is scanned, the constant scanning voltage is added to the adjusted offset voltage, increasing the gate voltage to $V_{G,\ 2}$.

The scope of the invention is not limited to manipulation of the offset voltage for achieving adjustment of the gate voltage. For example, the scanning voltage can be manipulated.

FIG. 6 illustrates a graph 170 of gate voltage and a graph 172 of anode current for a prior art method of operating a field emission display. As illustrated by graph 170, the gate voltage remains constant at $V_{G,\ 0}$ over the operating lifetime of the display. Furthermore, the anode current, which corresponds to the emission current, is not controlled, so that it decreases continuously during the operating lifetime of the display, as indicated by graph 172. Operation of the prior art FED starts at time $t_0$. The prior art display lifetime, $t'_{LIFE}$, is defined as the total operating time required for the anode current to reach a selected value, $I_{A,\ f}$. The value of $I_{A,\ f}$ is typically expressed as a percentage of an initial anode current, $I_{A,\ 0}$, such as 50% of $I_{A,\ 0}$.

Figure 7:
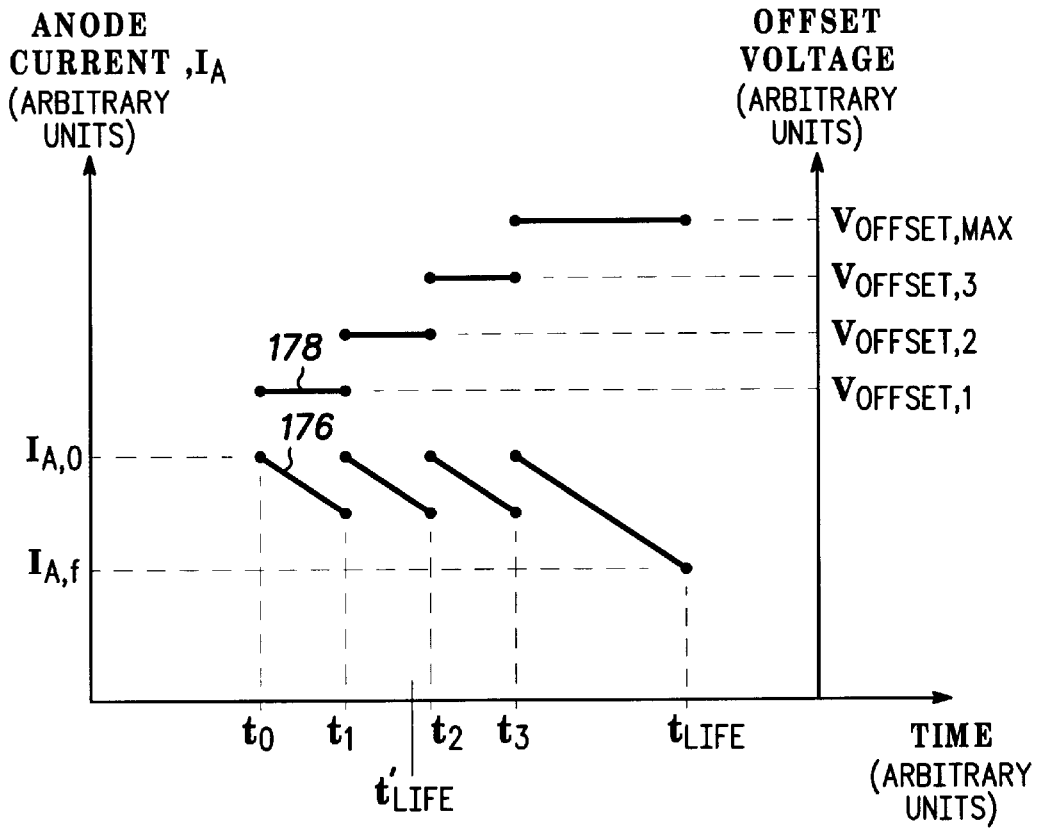
FIG. 7 illustrates graphs of anode current and offset voltage, in accordance with the method of the invention.

FIG. 7 illustrates a graph 176 of anode current 144 and a graph 178 of offset voltage, in accordance with the method of the invention. The abscissa represents operating time, during which FED 100 is in a display mode of operation. Thus, illustrated in FIG. 7 are at least four periods of operation of FED 100. The times specifically indicated on the abscissa in FIG. 7 do not necessarily correspond to times specifically indicated in the other figures of the description.

In the example of FIG. 7, the control method of the invention is performed at each start up of FED 100, just prior to a period of operation. For the purpose of distinguishing or contrasting the display operating lifetime from that of the prior art, the initial value, $I_{A,\ 0}$, and final value, $I_{A,\ f}$, of anode current 144 in FIG. 7 are selected to be equal to those of FIG. 6.

Operation of FED 100 begins at time $t_0$. A period of operation also begins at each of times $t_1$, $t_2$, and $t_3$. Further shown at times $t_1$, $t_2$, and $t_3$, are the values of anode current 144 and offset voltage existing prior to and following control of the emission current, in accordance with the invention. For example, at time $t_1$, the lower point on graph 176 indicates the value of anode current 144 at the end of the first period of operation.

At the start-up of FED 100, immediately prior to the second period of operation, the method of the invention is employed to adjust the offset voltage from $V_{OFFSET,\ 1}$ TO $V_{OFFSET,\ 2}$. The adjusted offset voltage causes anode current 144 to return to the set point, which is the initial value, $I_{A,\ 0}$, of anode current 144.

The operating lifetime, $t_{LIFE}$, of FED 100 is determined by a maximum offset voltage, $V_{OFFSET,\ MAX}$, and by the lower limit, $I_{A,\ f}$, of anode current 144. The maximum offset voltage can be defined by the operating limits of offset voltage source 160. The maximum offset voltage can equal a maximum voltage provided by offset voltage source 160. Alternatively, the maximum offset voltage may be defined by limits placed upon switching power requirements or by driver limitations.

Thus, for the embodiment represented by FIG. 7, the operating lifetime includes the time, $t_3$, required to reach the maximum offset voltage, $V_{OFFSET,\ MAX}$. The operating lifetime further includes the operating time ($t_{LIFE}-t_3$) required for anode current 144 to reach the selected, final value, $I_{A,\ f}$, while FED 100 operates at a constant offset voltage of $V_{OFFSET,\ MAX}$.

The slopes of the segments of graph 176 are depicted in FIG. 7 as being equal. However, they may differ. Also, the difference in anode current (graph 176) between consecutive operating periods, represented at times $t_1$, $t_2$, and $t_3$, is depicted as being constant. However, the difference in anode current may vary. Furthermore, the duration of each operating period is not necessarily the same.

Indicated in FIG. 7 is the lifetime, $t'_{LIFE}$, of the prior art represented in FIG. 6. As is evident from FIG. 7, the method of the invention provides an appreciably improved display operating lifetime, $t_{LIFE}$, over that of the prior art. However, the realized improvement in lifetime may not be equal to that shown in FIG. 7.

As described with reference to FIG. 7, adjustment of the gate voltage in accordance with the invention can occur at each start-up of the display. The scope of the invention is not limited to this particular timing scheme. For example, the steps of the invention can be performed at the end of selected display frames, during blanking intervals.

FIG. 8 is a circuit diagram of control circuit 111, in accordance with the preferred embodiment of the invention. In the embodiment of FIG. 8, current controller 154 includes a counter 182 and a comparator 184, and offset voltage source 160 includes a variable resistor 193 and a regulator 200, which is connected in parallel to a resistor 202.

Control circuit 111 of FIG. 8 further includes an electric relay 179 and a variable resistor 181, which are useful for adjusting the anode voltage, $V_A$. Electric relay 179 is connected, at a first terminal, to a feedback circuit (not shown) of power supply 146 and, at a second terminal, to variable resistor 181. Electric relay 179 is controlled by a signal (not shown), which causes electric relay 179 to make or break the connection between power supply 146 and variable resistor 181.

A first input 186 of counter 182 is connected to the output of sensor 150. The output of counter 182 is connected to an input of comparator 184, and outputs 192 of comparator 184 are connected to inputs of variable resistor 193.

In the embodiment of FIG. 8, sensor 150 is a pulse modulator, such as a pulse width modulator and/or a pulse frequency modulator. Output signal 152 is a digital signal. The width and frequency of the pulses encode information corresponding to the operating parameters of power supply 146. That is, output signal 152 is a function of, for example, time, temperature, output power, and/or duty cycle.

Output signal 152 is transmitted to first input 186 of counter 182. A buffer 195 is connected to first input 186 of counter 182 to minimize the loading of output signal 152. First input 186 is connected to the clock of counter 182. Counter 182 has a second input 188, which is connected to the clock enabler of counter 182. Second input 188 is designed to receive a counter enabler signal 180. Counter 182 generates an output signal 190, which is a data signal including N bits.

Variable resistor 193 includes a plurality of resistors 198, 196, which are connected in parallel. The resistance of each of resistors 198, 196 is individually selected and need not be equal to the same value. Each of resistors 198 is further connected in series to a transistor 194, which performs a switching function to allow control of current flow through resistors 198. The base of each transistor 194 is connected to one of outputs 192 of comparator 184. Comparator 184 controls the effective resistance of variable resistor 193 by controlling the operational status of transistors 194.

The effective resistance, $R_{effective}$, of variable resistor 193 is given by the following equation:

$$R_{effective}=1/(1/R1+\Sigma 1/R), \quad (1)$$

where:

R1=the resistance of resistor 196, and the summation is performed over those of resistors 198 through which current flow is enabled.

Regulator 200 is an adjustable linear regulator. Thus, the offset voltage, $V_{OFFSET}$, is given by the following equation:

$$V_{OFFSET}=V_b(R_2/R_{effective}), \quad (2)$$

where:

$V_b$=a constant defined by the adjustable linear regulator, $R_2$=the resistance of resistor 202, and $R_{effective}$=as defined by Equation (1) above.

Equation (2) is valid as long as the value of a voltage signal 197 applied to an input of regulator 200 is greater than the output voltage, which is $V_{OFFSET}$.

Equations (1) and (2) show that, as resistors 198 are effectively added by comparator 184, the effective resistance of variable resistor 193 falls, and the offset voltage increases.

Comparator 184 utilizes the information provided by output signal 190 to determine the required adjustment of the offset voltage. In the embodiment of FIG. 8, the offset voltage is determined by the effective resistance of variable resistor 193. Thus, comparator 184 performs the function of enabling the required effective resistance of variable resistor 193.

For example, the step of adjusting the gate voltage can be achieved by mapping a detected value of emission current 134 into a set point value to define the adjusted gate voltage. For the embodiment of FIG. 8, the mapping operation utilizes the detected value of emission current 134 to arrive at a configuration for variable resistor 193, which will produce the adjusted offset voltage. The mapping operation can be implemented using a look-up table. The information in the look-up table is generated by employing a mapping function.

Formulation of the mapping function requires information about the relationship between emission current 134 and the gate voltage. For example, a useful approximation is that emission current 134 is proportional to the offset voltage. Alternatively, a more precise relationship can be determined for a given display design, by using empirical methods or computer simulations, and can be utilized as described in greater detail with reference to FIG. 9.

Formulation of the mapping function further requires information about the relationship between emission current 134 and anode voltage. In general, emission current varies with anode voltage. Furthermore, in accordance with the method of the invention, the anode voltage is preferably not constant throughout the control and display modes of operation of FED 100.

During the steps for controlling emission current 134, in accordance with the method of the invention (control mode), anode voltage, $V_A$, at anode 138 preferably equals a control value, $V_{A,C}$. However, during the display mode of operation of FED 100, the anode voltage is equal to operating anode voltage, $V_{A,OP}$. The control value, $V_{A,C}$, is less than operating anode voltage, $V_{A,OP}$. The control value is selected to reduce or eliminate emission of visible light at anode plate 114 during the control mode of operation, whereas the operating anode voltage is selected to provide a display image having a particular level of brightness.

Thus, the set point value of emission current 134 during the control mode of operation does not equal the desired value of emission current 134 selected for the display mode of operation. Rather, the set point value for the control mode is selected to take into account the effect upon emission current 134 of the increase in the anode voltage, when FED 100 enters the display mode of operation.

Figure 9:
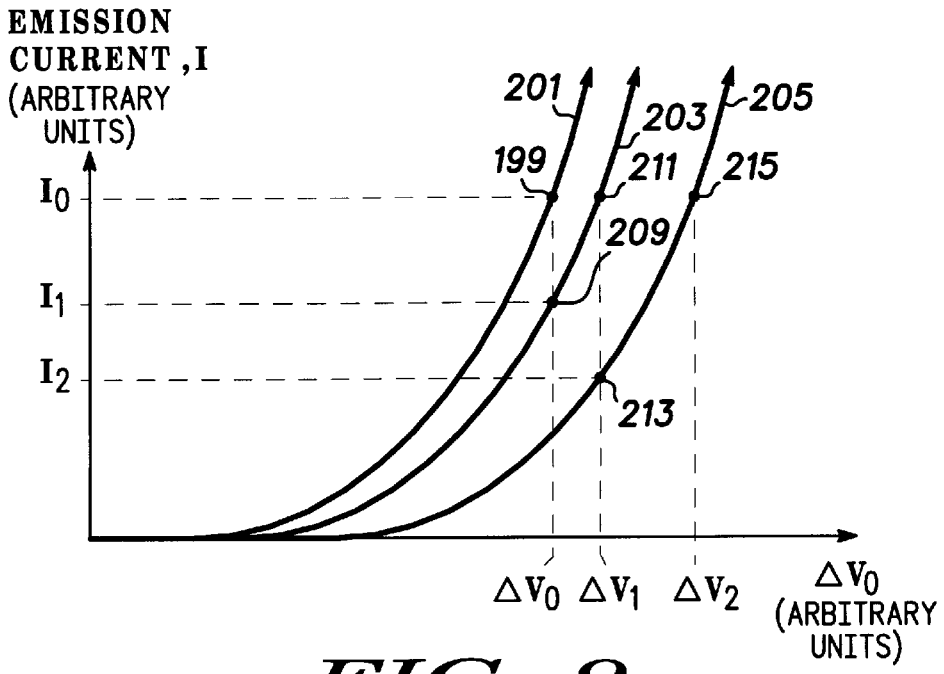
FIG. 9 is a family of operating curves of emission current versus potential difference for a field emission display, and further illustrates a mapping function, in accordance with the method of the invention.

FIG. 9 is a family of operating curves 201, 203, 205, of emission current, I, versus potential difference, ΔV, (between column voltage and gate voltage) for FED 100 at a constant temperature. FIG. 9 further illustrates a mapping function for mapping a measured operating point into an operating point having an emission current equal to the set point value, in accordance with the method of the invention. In general, the operating curve of FED 100 changes with respect to operating time due to the contamination of electron emitter structures 124. That is, chemical alteration of the emissive surfaces results in alteration of the work function of the surface and, therefore, produces a shift in the operating curve.

First operating curve 201 of FIG. 9 is the initial operating curve of FED 100. Second operating curve 203 is the operating curve at the time of a first detection and adjustment of emission current 134, in accordance with the method of the invention. Third operating curve 205 is the operating curve of FED 100 at the time of a second detection and adjustment of emission current 134, in accordance with the method of the invention.

Initially, FED 100 operates at a first operating point 199 on first operating curve 201; emission current 134 is equal to $I_0$, which is the desired value, and ΔV is equal to $\Delta V_0$. During the first operating period, the value of emission current 134 decreases due to, for example, contamination of electron emitter structures 124.

At the start-up of FED 100 following the first operating period, the value of emission current 134 is detected at a value of $I_1$, and ΔV remains unchanged at a value of $\Delta V_0$, so that FED 100 operates at a second operating point 209. Determination of the operating point allows identification of the operating curve, which is second operating curve 203 in this example.

By identifying the operating curve, the required ΔV can be found. The required ΔV is found by identifying the operating point along the operating curve that includes an emission current equal to $I_0$, the desired value. In this manner, a third operating point 211 is selected along second operating curve 203, and the required value of ΔV is found to be $\Delta V_1$. Because the values of ΔV, scanning voltage, and column voltage are known, the required offset voltage can be calculated. The required effective resistance of variable resistor 193 can then be determined.

The mapping function is similarly utilized to calculate the required offset voltage for use during the third operating period, as further illustrated in FIG. 9. At the start-up of the third operating period, the value of emission current 134 is detected at a value of $I_2$, and ΔV is at a value of $\Delta V_1$, so that FED 100 operates at a fourth operating point 213, which is on third operating curve 205. A fifth operating point 215 is the operating point on third operating curve 205 that includes the desired emission current, $I_0$. The required value of ΔV for the third operating period is therefore $\Delta V_2$.

Figure 10:
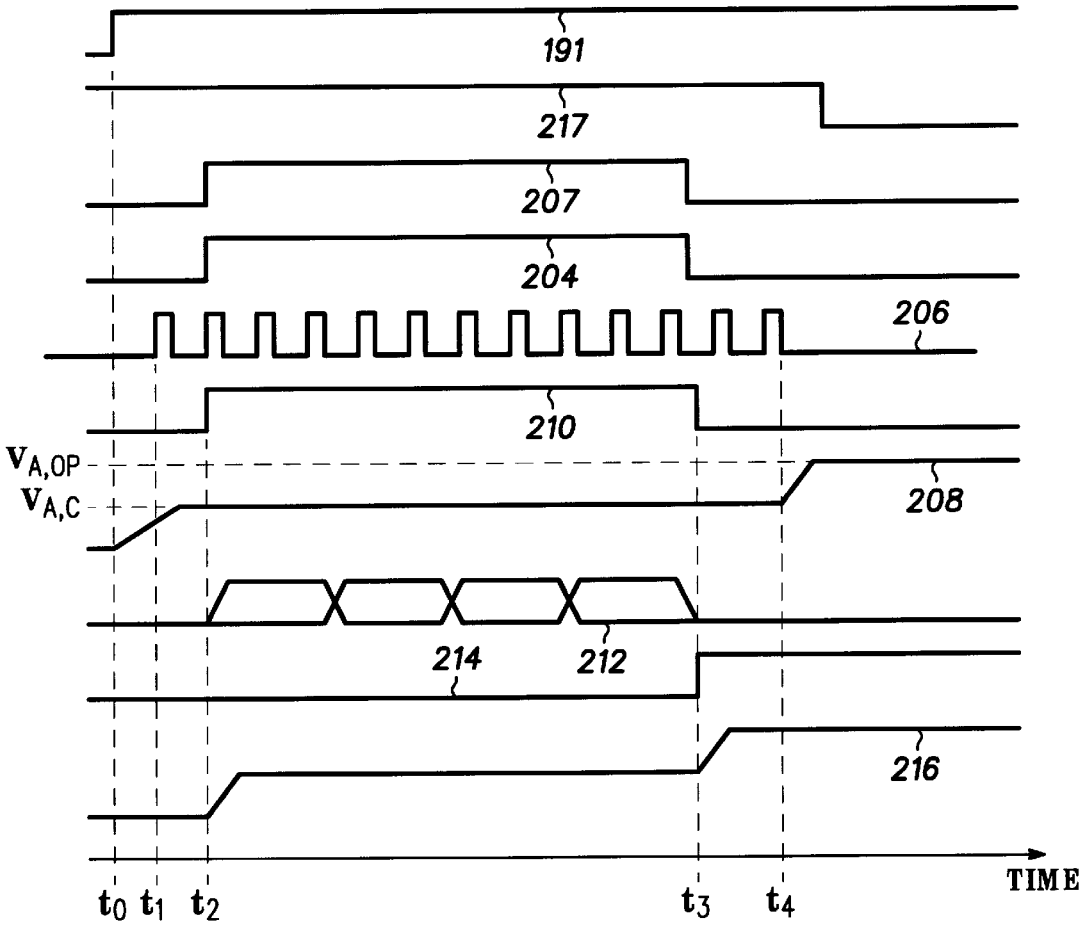
FIG. 10 is a timing diagram of the operation of the embodiment of FIG. 8, in accordance with the method of the invention.

FIG. 10 is a timing diagram of the operation of the embodiment of FIG. 8, in accordance with the method of the invention. To control emission current 134, first, at time $t_0$, power supply 146 is powered up, as represented by a graph 191 in FIG. 10.

Output signal 148 is represented by a graph 204 in FIG. 10. In the embodiment of FIG. 8, output signal 148 is an alternating current (A.C.) signal corresponding to the power output of power supply 146. Starting at time t, and in response to output signal 148, the pulse modulator of sensor 150 produces output signal 152, which is represented by a graph 206 in FIG. 10.

At time $t_0$, the anode voltage, $V_A$, at anode 138 (FIG. 1) is ramped up to control value, $V_{A,C}$, as illustrated in a graph 208 of FIG. 10. During the display mode of operation of FED 100, the anode voltage is increased to operating anode voltage, $V_{A,OP}$, as illustrated by graph 208 at time $t_4$.

The value of the anode voltage is determined by the configuration of electric relay 179 and variable resistor 181 (FIG. 8). During the control mode of operation, electric relay 179 is caused to break the connection between power supply 146 and variable resistor 181. This configuration of electric relay 179 is represented by a graph 217 for times less than time $t_4$. Graph 217 further shows that, at time $t_4$, electric relay 179 is caused to make a connection between power supply 146 and variable resistor 181. The value of the anode voltage ($V_{A,OP}$) for times greater than $t_4$ is determined by the value of the resistance of variable resistor 181.

At time $t_2$, counter enabler signal 180 is fed to second input 188, for enabling counter 182, as represented by a graph 210 in FIG. 10. When enabled, counter 182 generates the counter bits of output signal 190, as illustrated by a graph 212.

The offset voltage, which is represented by a graph 216, is set to an initial value, which can be a default setting or the value that was used during a period of operation immediately prior to the current control sequence. The offset voltage is applied to all gate extraction electrodes of FED 100.

The scanning voltage is also applied to all gate extraction electrodes of the array by circuitry (not shown). Emission-activating potentials are applied to all column electrodes of FED 100. In this manner at time $t_2$, all of electron emitter structures 124 are caused to emit electrons, thereby defining emission current 134, as represented by a graph 207 of FIG. 10.

Preferably, all of electron emitter structures 124 in the array are caused to emit. However, the scope of the invention is not limited to this configuration; fewer than all of electron emitter structures 124 can be caused to emit. Activation of the entire array, or a substantial portion thereof, is beneficial for reducing signal errors that may be caused by electrical signal noise. That is, as the measured value of emission current 134 increases, the error due to signal noise decreases. Emission current 134 is then received at anode 138 (FIG. 1). Generation of emission current 134 causes a change in output signal 148, as indicated by graph 204 at time $t_2$.

During the period between times $t_2$ and $t_3$, control circuit 111 measures emission current 134 and compares the measured value with a set point value. In the embodiment of FIG. 8, emission current 134 is measured by measuring a power output of power supply 146. The power output can be measured, for example, by measuring the duty cycle of power supply 146.

If the measured value of emission current 134 is not equal to the set point value, comparator 184 activates an effective resistance of variable resistor 193, which adjusts the gate voltage in a manner sufficient to cause emission current 134 to approach the set point value. Most preferably, emission current 134 is caused to equal the set point value.

At time $t_3$, comparator 184 activates selected ones of transistors 194, as represented by a graph 214 in FIG. 10. In the example of FIG. 10, the effective resistance of variable resistor 193 is decreased, causing an increase in the offset voltage, as illustrated by graph 216 at time $t_3$.

Subsequent to the adjustment of the effective resistance, counter enabler signal 180 (graph 210) ceases the counting of counter 182. Also, electron emission, for the purpose of controlling emission current 134, is terminated, as indicated by graph 207 at time $t_3$. Termination of emission by the array causes a change in output signal 148, as indicated by graph 204 at time $t_3$.

At time $t_4$, the anode voltage is increased to operating anode voltage, $V_{A,OP}$, as illustrated by graph 208. The operating anode voltage is selected to provide a useful brightness level for creating the display image. The anode voltage is increased by causing electric relay 179 to make a connection between power supply 146 and variable resistor 181 (FIG. 8), which is represented by graph 217 at time $t_4$.

Figure 11:
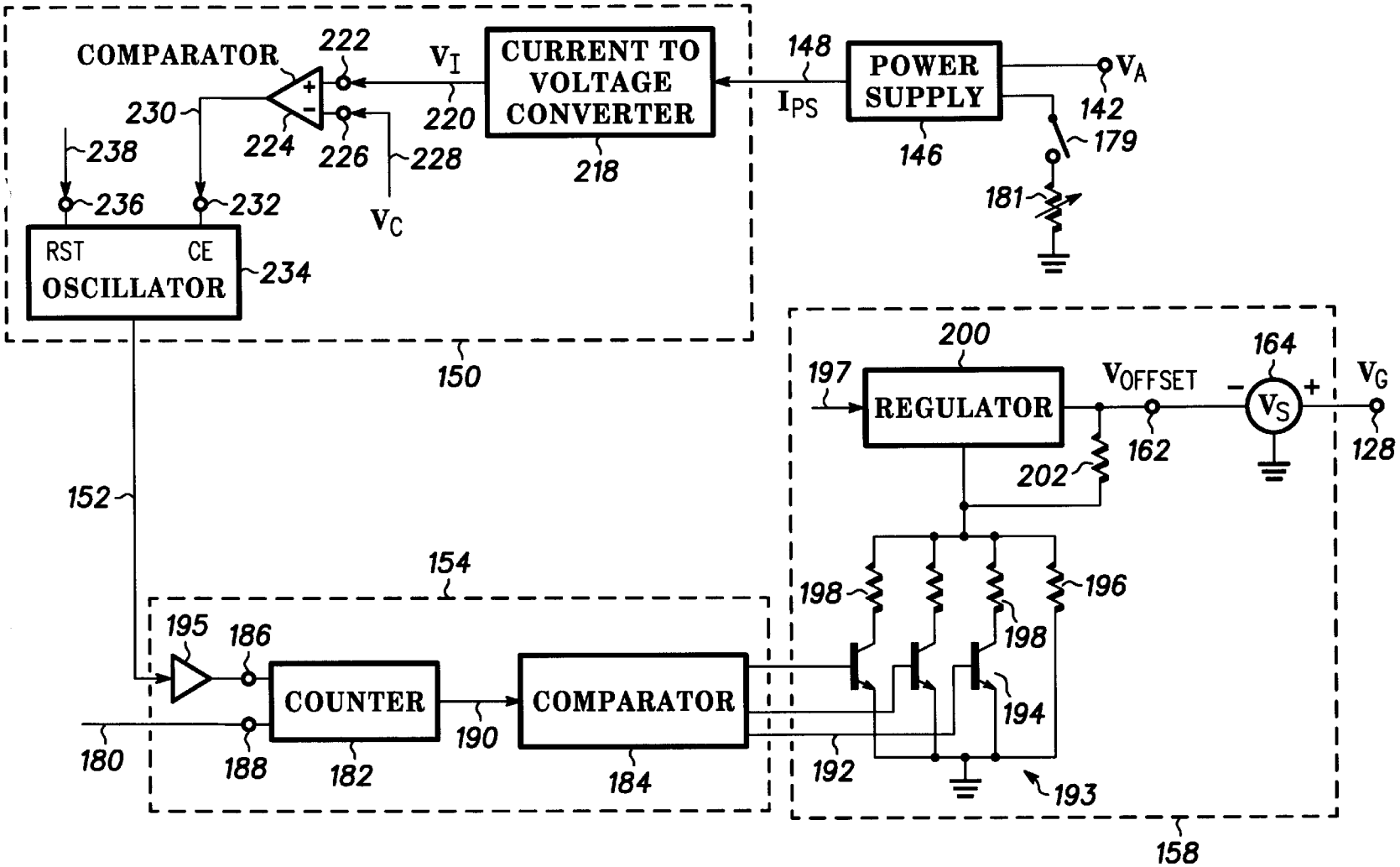
FIG. 11 is a circuit diagram of a control circuit for controlling emission current, in accordance with another embodiment of the invention.

FIG. 11 is a circuit diagram of control circuit 111 for controlling emission current 134, in accordance with another embodiment of the invention. In the embodiment of FIG. 11, emission current 134 is measured by measuring a current, $I_{PS}$, passing through power supply 146. For example, the measured current can be a current passing through a secondary coil of a stepping-up transformer of power supply 146. In the embodiment of FIG. 11, output signal 148 from power supply 146 is a current signal.

In the embodiment of FIG. 11, sensor 150 includes a current-to-voltage converter 218, a second comparator 224, and an oscillator 234. An input of current-to-voltage converter 218 is designed to be connected to power supply 146, and an output of current-to-voltage converter 218 is connected to a first input 222 of second comparator 224. A second input 226 of second comparator 224 is designed to receive a reference voltage signal 228.

The output of second comparator 224 is connected to a first input 232 of oscillator 234. A second input 236 of oscillator 234 is connected to a reset and is designed to receive a reset signal 238. The output of oscillator 234 is connected to first input 186 of counter 182 of current controller 154. The circuitry of current controller 154 and gate voltage source 158 is described with reference to FIG. 8.

Figure 12:
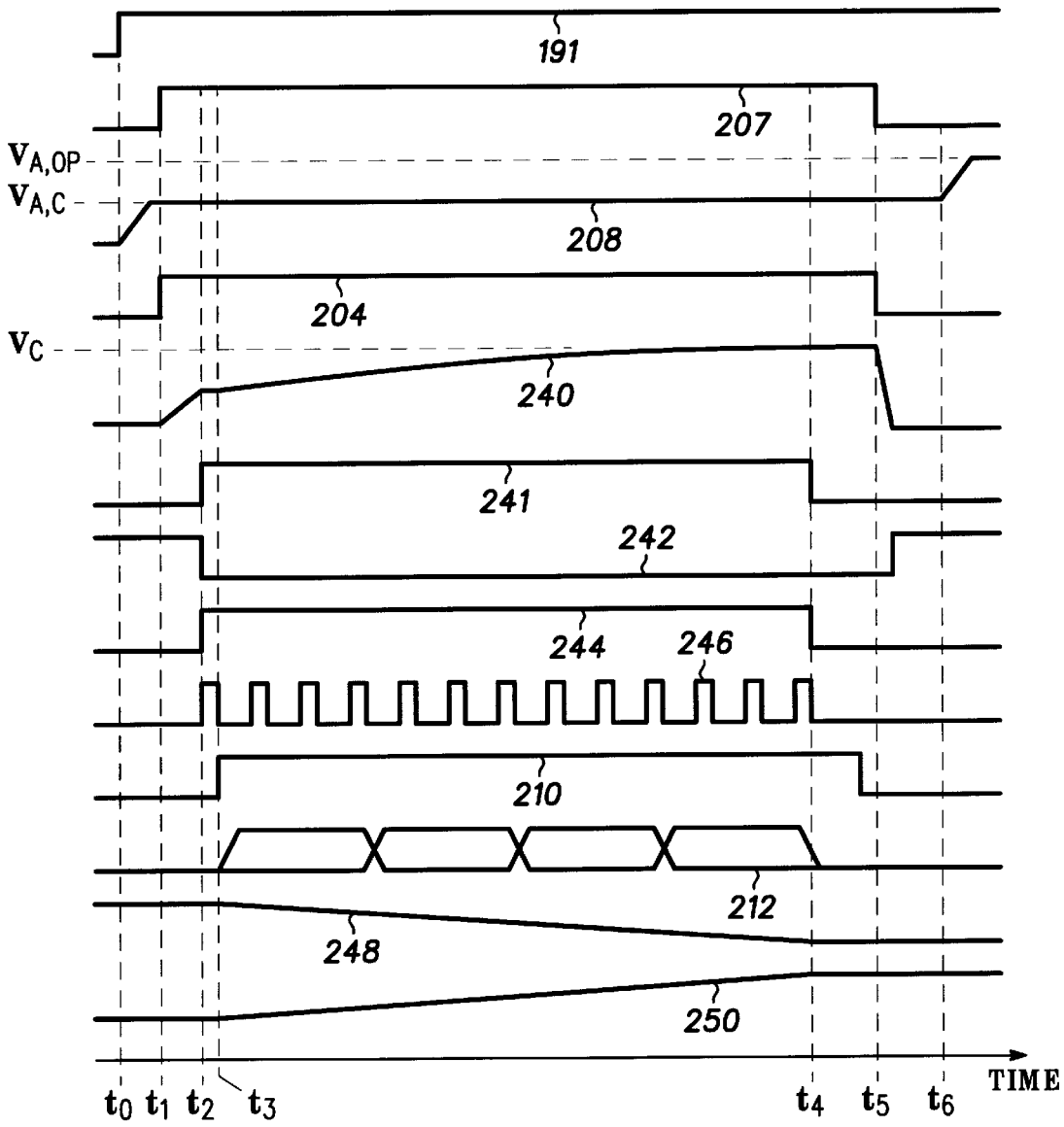
FIG. 12 is a timing diagram of the operation of the embodiment of FIG. 11, in accordance with the method of the invention.

FIG. 12 is a timing diagram of the operation of the embodiment of FIG. 11, in accordance with the method of the invention. To control emission current 134, first, at time $t_0$, power supply 146 is powered up, as represented by graph 191 in FIG. 12. Also at time $t_0$, the anode voltage is ramped up to control value, $V_{A,C}$, as illustrated by graph 208.

At time $t_1$, as illustrated by a graph 250, the offset voltage is equal to an initial value, which can be a default setting or the value that was used during a period of operation immediately prior to the current control sequence. The offset voltage is applied to all of the gate extraction electrodes of FED 100.

The scanning voltage is also applied to all of the gate extraction electrodes of the array by circuitry (not shown). Emission-activating potentials are applied to all of the column electrodes of FED 100. In this manner, all of electron emitter structures 124 are caused to emit electrons, thereby defining emission current 134. As represented by graph 207 of FIG. 12, electron emission commences at time $t_1$. Emission current 134 is then received at anode 138 (FIG. 1). Output signal 148 is represented by graph 204. At time t1, output signal 148 changes in response to the generation of emission current 134.

Output signal 148 from power supply 146 is transmitted to current-to-voltage converter 218, which includes circuitry useful for converting the current signal of output signal 148 to a corresponding voltage signal 220. For example, current-to-voltage converter 218 can be a simple resistor. The value, $V_I$, of voltage signal 220 is represented by a graph 240 in FIG. 12. The control of $V_I$ commences at time $t_3$, at which time current controller 154 is activated, in the manner described with reference to FIGS. 8 and 10.

At time $t_2$, reference voltage signal 228 is applied to second input 226 of second comparator 224, as represented by a graph 241 in FIG. 12. A set point value, $V_C$, of reference voltage signal 228 corresponds to the desired value of emission current 134 during the control mode of operation. Also at time $t_2$, reset signal 238 is applied to second input 236 of oscillator 234, as shown by a graph 242 in FIG. 12.

Second comparator 224 compares the value, $V_I$, of voltage signal 220 with set point value, $V_C$, of reference voltage signal 228. As long as $V_C$ is greater than $V_I$, an output signal 230 of second comparator 224 defines an enabling signal, which activates the clock enabler of oscillator 234. Between times $t_2$ and $t_4$, $V_I$ is less than $V_C$, and output signal 230 is activated to its enabling state, as shown by a graph 244.

Oscillator 234 is responsive to output signal 230 of second comparator 224 and generates output signal 152, which is represented by a graph 246 in FIG. 12. At time $t_3$, counter enabler signal 180 enables counter 182, as shown by graph 210. In response to output signal 152 of sensor 150, counter 182 generates output signal 190, which is represented by graph 212 in FIG. 12.

Comparator 184 and gate voltage source 158 function in a manner similar to that described with reference to FIGS. 8 and 10, resulting in the adjustment of the effective resistance of variable resistor 193, as illustrated by a graph 248 in FIG. 12. As the effective resistance is reduced, the offset voltage increases, as shown by graph 250.

The adjustments cease when $V_I$ is equal to $V_C$ (graph 240), which occurs at time $t_4$ in the present example. At this time, output signal 230 (graph 244) of second comparator 224 defines a non-enabling signal, which does not activate the clock enabler of oscillator 234. Thus, oscillator 234 ceases to generate output signal 152 (graph 246), and no bits are transmitted by counter 182 (graph 212).

The set point value of reference voltage signal 228 is removed from second comparator 224 (graph 241). Electron emission by the array of electron emitter structures is thereafter terminated at time $t_5$ (graph 207), which causes a change in output signal 148 (graph 204) and further causes the value of $V_I$ to drop (graph 240). At time $t_6$, the anode voltage (graph 208) is ramped up to the operating anode voltage, $V_{A,\ OP}$, in the manner described with reference to FIG. 10.

In summary, the invention is for a method and a field emission display useful for maintaining a constant emission current over the lifetime of the display. In the preferred embodiment, the method of the invention includes a step for manipulating a gate voltage to cause an emission current to equal a set point value. The preferred embodiment of a field emission display in accordance with the invention includes a control circuit for controlling the emission current at start-up. The method and display of the invention provide the benefits of constant brightness and an improved display operating lifetime compared to operation at a constant gate voltage.

While we have shown and described specific embodiments of the present invention, further modifications and improvements will occur to those skilled in the art. For example, the step of mapping a measured value of emission current into a set point value can include using operating curves that take into account the effects of variation in temperature. In another example, the second comparator can include a low-pass filter circuit. In yet a further example and in accordance with the invention, the emission current can be measured by measuring the anode current at the input to the anode.

We desire it to be understood, therefore, that this invention is not limited to the particular forms shown and we intend in the appended claims to cover all modifications that do not depart from the spirit and scope of this invention.

What is claimed is:

1. A method for controlling an emission current in a field emission display having a plurality of electron emitter structures, a gate extraction electrode, and an anode, the method comprising the steps of:

causing the plurality of electron emitter structures to emit electrons, thereby defining the emission current;

measuring the emission current, thereby defining a measured value;

comparing the measured value with a set point value;

applying a gate voltage to the gate extraction electrode; and if the measured value is not equal to the set point value, adjusting the gate voltage in a manner sufficient to cause the emission current to approach the set point value.

2. The method for controlling an emission current in a field emission display as claimed in claim 1, wherein the step of measuring the emission current comprises the steps of receiving the emission current at the anode, thereby defining an anode current, and measuring the anode current.

3. The method for controlling an emission current in a field emission display as claimed in claim 1, wherein the field emission display is characterized by an operating anode voltage, and further comprising, concurrent with the step of causing the plurality of electron emitter structures to emit electrons, the step of providing at the anode a first anode voltage, wherein the first anode voltage is less than the operating anode voltage.

4. The method for controlling an emission current in a field emission display as claimed in claim 1, further comprising the step of connecting the anode to a power supply, and wherein the step of measuring the emission current comprises the steps of receiving the emission current at the anode and measuring a current passing through the power supply.

5. The method for controlling an emission current in a field emission display as claimed in claim 1, wherein the steps are performed at start-up of the field emission display.

6. The method for controlling an emission current in a field emission display as claimed in claim 1, wherein the step of adjusting the gate voltage comprises the step of adjusting the gate voltage in a manner sufficient to cause the emission current to equal the set point value.

7. The method for controlling an emission current in a field emission display as claimed in claim 1, wherein the step of applying a gate voltage comprises the step of applying an offset voltage to the gate extraction electrode, and wherein the step of adjusting the gate voltage comprises the step of adjusting the offset voltage in a manner sufficient to cause the emission current to approach the set point value.

8. The method for controlling an emission current in a field emission display as claimed in claim 1, wherein the step of adjusting the gate voltage comprises the steps of mapping the measured value into the set point value to define an adjusted gate voltage and applying the adjusted gate voltage to the gate extraction electrode.

9. The method for controlling an emission current in a field emission display as claimed in claim 1, further comprising the step of connecting the anode to a power supply, and wherein the step of measuring the emission current comprises the steps of receiving the emission current at the anode and measuring a power output of the power supply.

10. The method for controlling an emission current in a field emission display as claimed in claim 9, wherein the step of measuring a power output of the power supply comprises the step of measuring a duty cycle of the power supply.

11. A field emission display comprising:

a cathode plate having a plurality of electron emitter structures and a gate extraction electrode spaced apart from the plurality of electron emitter structures;

an anode plate disposed to receive electrons emitted by the plurality of electron emitter structures and having an anode, wherein the anode is designed to be connected to a power supply;

a sensor having an input and an output, wherein the input is designed to be connected to the power supply;

a current controller having an input and an output, wherein the input of the current controller is connected to the output of the sensor; and a gate voltage source having an input and an output, wherein the input of the gate voltage source is connected to the output of the current controller, and wherein the output of the gate voltage source is connected to the gate extraction electrode.

12. The field emission display as claimed in claim 11, wherein the current controller comprises a counter having an input and an output and further comprises a comparator having an input and an output, wherein the input of the counter is connected to the output of the sensor, wherein the output of the counter is connected to the input of the comparator, and wherein the output of the comparator is connected to the input of the gate voltage source.

13. The field emission display as claimed in claim 11, wherein the sensor comprises a pulse modulator.

14. The field emission display as claimed in claim 11, wherein the sensor comprises a current-to-voltage converter having an input and an output, a comparator having first and second inputs, and an oscillator having an input and an output; wherein the input of the current-to-voltage converter is designed to be connected to the power supply; wherein the output of the current-to-voltage converter is connected to the first input of the comparator; wherein the second input of the comparator is designed to receive a reference voltage signal; wherein the output of the comparator is connected to the input of the oscillator; and wherein the output of the oscillator is connected to the input of the current controller.

15. The field emission display as claimed in claim 11, wherein the gate voltage source comprises an offset voltage source and a scanning voltage source, wherein the offset voltage source is operably connected to the scanning voltage source, such that the scanning voltage source, when activated, adds a scanning voltage to an offset voltage provided by the offset voltage source.

16. The field emission display as claimed in claim 15, wherein the offset voltage source is connected in series with the scanning voltage source.

17. The field emission display as claimed in claim 15, wherein the offset voltage source comprises a variable resistor.

* * * * *